US012264818B2

(12) United States Patent
Ogawa et al.

(10) Patent No.: US 12,264,818 B2
(45) Date of Patent: Apr. 1, 2025

(54) PREMIXING DEVICE AND COMBUSTION DEVICE INCLUDING THE PREMIXING DEVICE

(71) Applicant: NORITZ CORPORATION, Hyogo (JP)

(72) Inventors: Kyohei Ogawa, Hyogo (JP); Shigeo Sugie, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 459 days.

(21) Appl. No.: 17/942,171

(22) Filed: Sep. 11, 2022

(65) Prior Publication Data

US 2023/0102736 A1 Mar. 30, 2023

(30) Foreign Application Priority Data

Sep. 28, 2021 (JP) ..... 2021-157500

(51) Int. Cl.

| | |
|---|---|
| ***F23D 14/60*** | (2006.01) |
| ***F23D 14/02*** | (2006.01) |
| ***F23D 14/62*** | (2006.01) |
| ***F23D 14/70*** | (2006.01) |

(52) U.S. Cl.

CPC ..... *F23D 14/62* (2013.01); *F23D 14/02* (2013.01); *F23D 14/60* (2013.01); *F23D 14/70* (2013.01); *F23D 2203/007* (2013.01)

(58) Field of Classification Search

CPC ..... F23D 14/60; F23D 14/62; F23D 14/70; F23D 14/02; F23D 2203/007

See application file for complete search history.

(56) References Cited

U.S. PATENT DOCUMENTS

| | | | | |
|---|---|---|---|---|
| 9,677,759 | B2 | 6/2017 | Zatti et al. | |
| 2011/0139045 | A1* | 6/2011 | Zatti | F23N 5/242 431/89 |
| 2016/0161112 | A1* | 6/2016 | Zatti | F23D 14/34 431/354 |
| 2021/0394134 | A1* | 12/2021 | Miura | B01F 25/312 |
| 2022/0034503 | A1* | 2/2022 | Ogawa | F24H 1/0027 |

FOREIGN PATENT DOCUMENTS

| | | |
|---|---|---|
| JP | 6831285 | 2/2021 |

* cited by examiner

*Primary Examiner* — Alfred Basichas
(74) *Attorney, Agent, or Firm* — JCIPRNET

(57) ABSTRACT

A premixing device includes: a gas flow path for allowing air to flow; a gas outlet that allows fuel gas to flow out into the gas flow path by utilizing a negative pressure; and a flapper disposed in the gas flow path. The premixing device further includes an operation regulating part for the flapper which allows the opening degree of the flapper to change according to the air flow rate in a range below a predetermined upper limit position while preventing the flapper from rotating in an opening direction beyond the upper limit position. The operation regulating part is capable of selectively switching and setting one of a first upper limit position for normal combustion and a second upper limit position for fuel ignition. The opening degree of the flapper at the second upper limit position is smaller than that at the first upper limit position.

20 Claims, 3 Drawing Sheets

PREMIXING DEVICE AND COMBUSTION DEVICE INCLUDING THE PREMIXING DEVICE

CROSS-REFERENCE TO RELATED APPLICATION

This application claims the priority benefit of Japan application serial no. 2021-157500, filed on Sep. 28, 2021. The entirety of the above-mentioned patent application is hereby incorporated by reference herein and made a part of this specification.

BACKGROUND

Technical Field

The disclosure relates to a premixing device and a combustion device including the premixing device.

Here, "premixing" is a process of premixing air and a fuel gas to generate a combustible mixed gas for the purpose of performing premixing combustion.

Description of Related Art

As a specific example of the premixing device, there is one described in Patent Literature 1.

The premixing device described in Patent Literature 1 includes a Venturi-shaped gas flow path that opens one end to the outside and connects the other end to the intake side of the fan, allowing external air to flow in through the opening of the one end and flow in a predetermined direction when the fan is driven. This gas flow path is divided into a first flow path and a second flow path, and a gas outlet is individually provided on the inner peripheral wall surface of each of the first and second flow paths. Further, a flapper is provided in the first flow path. This flapper is rotatable around an axis extending in a direction intersecting the air flow direction, and changes the opening degree according to the air flow rate so that when the air flow rate in the gas flow path is small, the opening degree is smaller than when the air flow rate is large (the flow path area of the place where the flapper is provided becomes smaller).

In such a premixing device, air flows in the gas flow path and a negative pressure is generated in the vicinity of the gas outlet, so that the fuel gas flows out from the gas outlet to the gas flow path and is mixed with the air. In addition, when the air flow rate is low, the flapper closes the first flow path, so that the flow velocity of the second flow path becomes high, and the negative pressure acting on the gas outlet located in the second flow path is strengthened. As a result, even when the air flow rate is small, an appropriate amount of fuel gas can be discharged from the gas outlet by the negative pressure, and the turndown ratio can be increased.

However, in the above-mentioned conventional technology, there is still room for improvement as described below.

That is, when the air-fuel mixture generated by the premixing device is sent to the burner of the combustion device and ignited, under various conditions such as air temperature, humidity, atmospheric pressure, supply voltage to the ignition device, and fuel gas component in the air-fuel mixture, the energy required for ignition becomes large, and the ignition performance may deteriorate. Therefore, it is desired to appropriately eliminate such problems.

As a way for solving the above-mentioned problems, it is conceivable to increase the discharge energy of the ignition device. However, this is not appropriate because it leads to an increase in size and cost of the ignition device.

Further, as another way, for example, as described in Patent Literature 2, it is conceivable to provide a butterfly valve rotatable by a motor in the gas flow path and reduce the valve opening degree of the butterfly valve at the time of ignition. However, in this case, it is difficult to quickly rotate the butterfly valve in accordance with the air flow rate during normal combustion. Therefore, compared with the device using the flapper of Patent Literature 1, the responsiveness is inferior, and the performance of maintaining the air-fuel mixture at an appropriate air-fuel ratio is also inferior.

RELATED ART

Patent Literature

[Patent Literature 1] U.S. Patent Laid-Open No. 9677759

[Patent Literature 2] Japanese Patent Laid-Open No. 6831285

SUMMARY

Technical Problem

The disclosure has been conceived in view of the above-mentioned circumstances, and provides a premixing device which may have good flapper responsiveness, may have a good performance in maintaining an air-fuel mixture at an appropriate air-fuel ratio and may also have a good ignition performance, and a combustion device including the premixing device.

Solution to Problem

In order to solve the above problems, the following technical methods are provided in the disclosure.

A premixing device according to a first aspect of the disclosure includes: a gas flow path for allowing air to flow in a predetermined direction; at least one gas outlet that allows fuel gas to flow out into the gas flow path by utilizing a negative pressure generated in the gas flow path; and a flapper disposed in the gas flow path, being rotatable around an axis extending in a direction intersecting a flow direction of the air, and changing an opening degree according to an air flow rate so that when the air flow rate in the gas flow path is small, the opening degree is smaller than when the air flow rate is large. The premixing device further includes: an operation regulating part for the flapper which allows the opening degree of the flapper to change according to the air flow rate in a range below a predetermined upper limit position while preventing the flapper from rotating in an opening direction beyond the upper limit position. The operation regulating part is capable of selectively switching and setting one of a first upper limit position for normal combustion and a second upper limit position for fuel ignition as the upper limit position of the flapper, and the opening degree of the flapper at the second upper limit position is smaller than the opening degree of the flapper at the first upper limit position.

According to such a configuration, the following effects may be obtained.

That is, when the premixing device according to the disclosure is used as a component of a combustion device provided with a burner, the operation regulating part for the flapper is used during normal combustion of the combustion device, and the first upper limit position is set as the upper limit position of the flapper. The operation regulating part for the flapper regulates the upper limit position of the flapper, but does not prevent the flapper from rotating in response to the air flow rate in the range below the upper limit position. Therefore, it is possible to achieve good responsiveness of the operation of the flapper to the change of the air flow rate in the gas flow path, and good performance in maintaining the air-fuel mixture at an appropriate air-fuel ratio. Further, it is also possible to obtain a high turndown ratio.

In addition, in the combustion device, when fuel ignition is performed, the second upper limit position is set as the upper limit position of the flapper. When this second upper limit position is set, the maximum opening degree of the flapper becomes smaller than when the first upper limit position is set, and the air-fuel ratio of the air-fuel mixture may be made fuel-rich, so the ignition performance may be improved.

As described above, according to the disclosure, it is possible to appropriately improve the ignition performance while improving the responsiveness of the flapper.

In this disclosure, it is preferable that at least the second upper limit position of the first and second upper limit positions is changeable.

According to such a configuration, at least the second upper limit position of the first and second upper limit positions may be changed, so it is possible to optimize the air-fuel ratio of the air-fuel mixture, particularly the air-fuel ratio of the air-fuel mixture so as to improve the ignition performance, which is more preferable.

In this disclosure, it is preferable that the operation regulating part includes a contact member for contacting the flapper and an actuator capable of moving the contact member. A configuration in which the upper limit position of the flapper is set to the second upper limit position is a configuration in which the contact member is contactable with the flapper to prevent the flapper from further rotation when the flapper is at the second upper limit position, and a configuration in which the upper limit position of the flapper is set to the first upper limit position is a configuration in which the contact member or a member other than the contact member is contactable with the flapper to prevent the flapper from further rotation when the flapper is at the first upper limit position.

Here, "a member other than the contact member" corresponds to, for example, a member forming a gas flow path or the like (for example, a partition wall 32 of an embodiment described later).

According to such a configuration, it is possible to easily and appropriately set the first and second upper limit positions of the flapper, respectively.

In this disclosure, it is preferable that the actuator is capable of reciprocally moving the contact member in a direction facing the flapper, and is capable of fixing the contact member at a desired position within a range of a reciprocating stroke.

According to such a configuration, it is possible to easily change each of the first and second upper limit positions of the flapper to a desired position by driving the actuator and changing the fixed disposition position of the contact member.

In this disclosure, it is preferable that the gas outlet includes a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

According to such a configuration, the contact member configuring the operation regulating part for the flapper may be provided at a preferable position in order to easily and appropriately regulate the operation of the flapper by using the second gas outlet. Further, the actuator configuring the operation regulating part for the flapper may be easily provided outside the gas flow path.

A combustion device according to a second aspect of the disclosure includes: a fan; a premixing device provided on an intake side of the fan and mixing air and fuel gas and then sending it to the fan; and a burner that burns the fuel gas by receiving a mixture of the air and the fuel gas from the fan. The premixing device according to the first aspect of the disclosure is used as the premixing device.

According to such a configuration, the same effects as described for the premixing device according to the first aspect of the disclosure may be obtained.

Other features and advantages of the disclosure will become more apparent from the following description of embodiments of the disclosure with reference to the accompanying drawings.

DESCRIPTION OF EMBODIMENTS

Hereinafter, exemplary embodiments of the disclosure will be specifically described with reference to the drawings.

Figure 1:
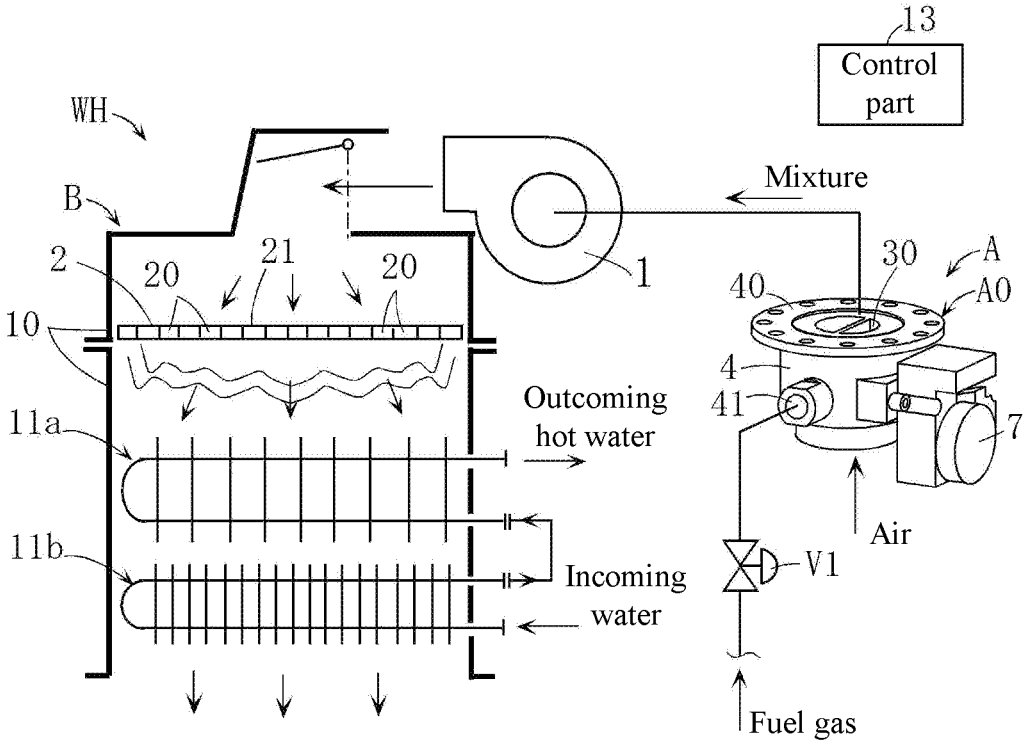
FIG. 1 is a schematic illustration view showing an example of a combustion device including a premixing device according to the disclosure.

FIG. 1 shows a premixing device A, a combustion device B (premixing combustion device) configured by combining the premixing device A with a fan 1 and a burner 2, and a hot water device WH configured by combining the combustion device B with a primary heat exchanger 11*a* and a secondary heat exchanger 11*b*.

The details of the premixing device A will be described later, and a mixed gas (combustible mixed gas) of air and fuel gas is generated using this premixing device A, and this mixed gas is supplied to the burner 2 via the fan 1. The burner 2 is configured to include a porous plate 21 having multiple ventilation holes 20 and is housed in a case 10. The burner 2 is provided with a spark plug (not shown), a flame detection sensor, and the like. The mixed gas passes through the multiple ventilation holes 20 and burns below the porous plate 21. The combustion gas generated by the burner 2 acts sequentially on the primary heat exchanger 11*a* for recovering the sensible heat and the secondary heat exchanger 11*b* for recovering the latent heat, and hot water that passes through the inside of the primary heat exchanger 11*a* and the secondary heat exchanger 11*b* is heated. This produces hot water, which is supplied to the desired hot water supply destination.

The hot water device WH includes a control part 13 configured by using a microcomputer or the like, and the control part 13 also executes operation control of an actuator 7 of the premixing device A, as will be described later.

Figure 2:
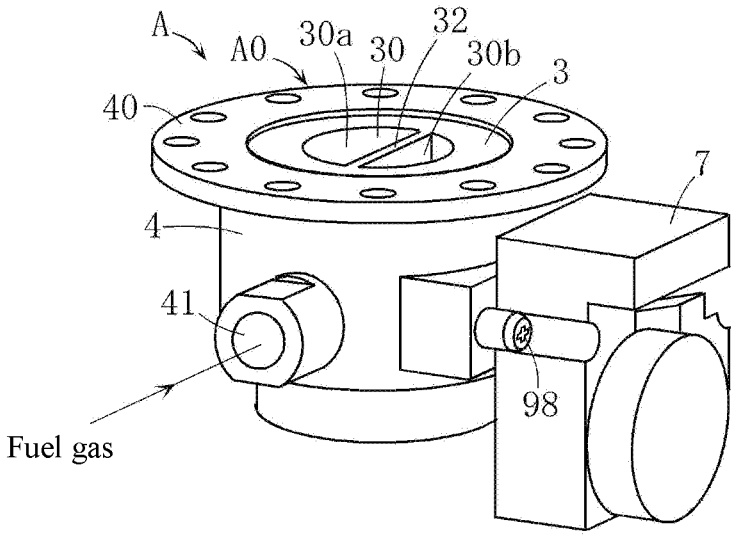
FIG. 2 is an external perspective view of the premixing device of FIG. 1.
Figure 3:
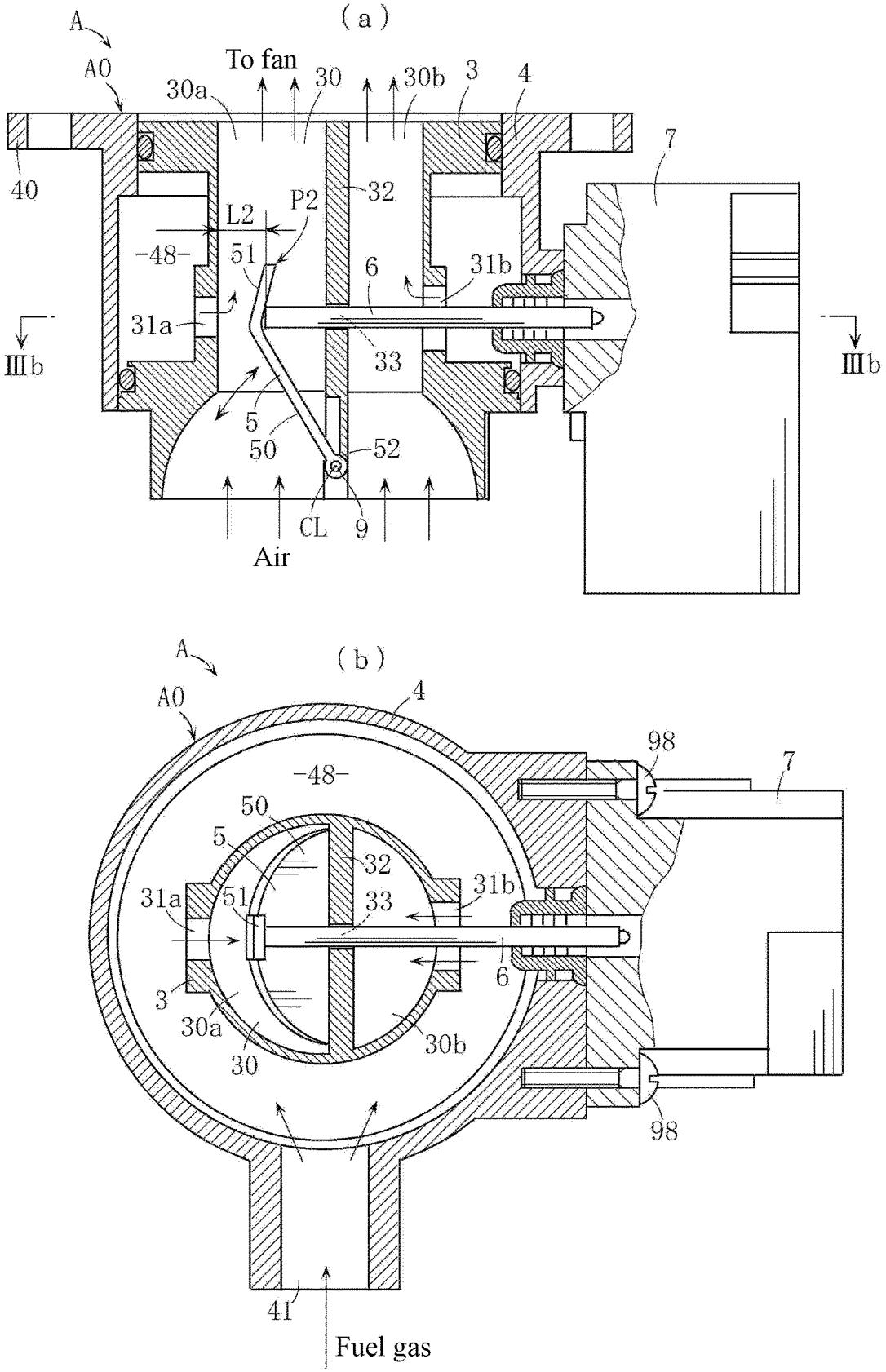
In FIG. 3, (a) is a cross-sectional view of the premixing device of FIGS. 1 and 2, and (b) is a cross-sectional view of IIIb-IIIb of (a).

As shown in FIGS. 2 and 3, the premixing device A includes a device body A0, a flapper 5 assembled to the device body A0, a contact member 6 for contacting the flapper 5 to regulate operation, and an actuator 7 for moving the contact member 6.

The combination of the contact member 6 and the actuator 7 corresponds to an example of the operation regulating part for the flapper in the disclosure.

The device body A0 is configured by the combination of a tubular gas flow path forming part 3 and a housing part 4 surrounding the outer periphery thereof; the tubular gas flow path forming part 3 has a Venturi-shaped gas flow path 30 formed therein and is provided with first and second gas outlets 31*a* and 31*b* on the inner peripheral wall of the gas flow path 30.

The housing part 4 has a flange part 40 and a fuel gas supply port 41. Fuel gas is supplied to the fuel gas supply port 41 from a fuel gas supply part such as a gas pipe via a pressure equalizing valve (zero governor) V1 (see FIG. 1). A space 48 is formed between the gas flow path 30 and the housing part 4, and the space 48 functions as a flow path that may guide the fuel gas supplied to the fuel gas supply port 41 to the first and second gas outlets 31*a* and 31*b*.

The device body A0 is directly connected to the intake side of the fan 1 by using the flange part 40, or is connected by piping. When the fan 1 is driven, external air flows into the gas flow path 30 from the opening on one end side thereof and flows toward the opening on the other end side. Due to the negative pressure action generated due to this air flow, fuel gas flows out from the first and second gas outlets 31*a* and 31*b* into the gas flow path 30, a mixture of air and fuel gas is generated, and is taken into the fan 1.

A partition wall 32 for partitioning the gas flow path 30 into the first and second flow paths 30*a* and 30*b* is provided at or near the central part of the gas flow path 30. The first and second gas outlets 31*a* and 31*b* are located in regions opposite to each other with the center of the gas flow path 30 in between so as to face the first and second flow paths 30*a* and 30*b* individually.

Figure 5:
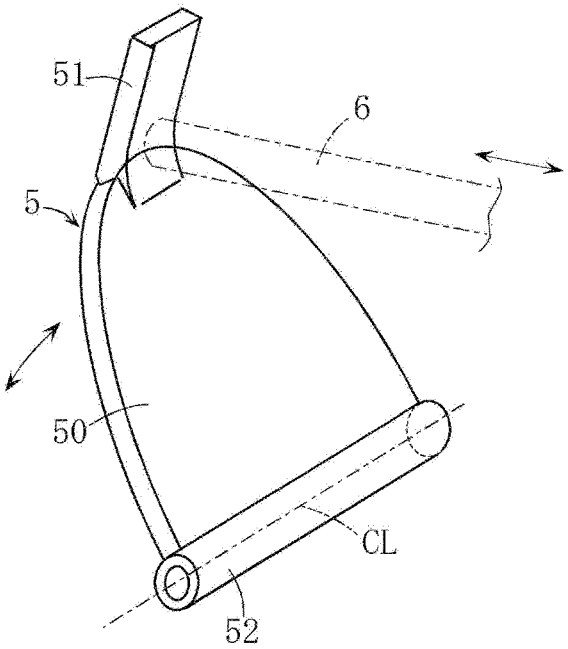
FIG. 5 is a perspective view of the flapper used in the premixing device shown in FIGS. 1 to 4.

The flapper 5 is a member that rotates in response to the air flow rate in the gas flow path 30 and changes the area that blocks the gas flow path 30. More specifically, as shown in FIG. 5, the flapper 5 includes a substantially semicircular plate-shaped flapper body 50, an extension 51 extending upward from the tip part of the flapper body 50, and a base end 52 for rotation support. The base end 52 is supported by a shaft part 9 provided to be located below the partition wall 32, and the flapper 5 is rotatable around an axis CL (corresponding to the central axis of the shaft part 9; see also FIG. 5) extending in a direction intersecting the air flow direction in the gas flow path forming part 3.

The upper part of the flapper 5 is located in the first flow path 30*a*, and when the air flow rate in the gas flow path 30*a* is smaller than a predetermined flow rate, the flapper 5 is in a in a closed state that closes the first flow path 30 and the first gas outlet 31*a*, respectively. In addition, when the air flow rate is greater than or equal to the predetermined flow rate, the flapper 5 is in an open state rotated in a direction away from the first gas outlet 31*a*. However, as described later, the upper limit position of the rotation may be switched to one of the first and second upper limit positions P1 and P2.

The contact member 6 has, for example, a shaft shape, is inserted into the second gas outlet 31*b* and a hole 33 provided in the partition wall 32, and a tip (one end) side of the contact member 6 is disposed to be able to contact the flapper 5. The base end (other end) side of the contact member 6 is supported by the actuator 7. The second gas outlet 31*b* has a larger opening size than the first gas outlet 31*a* to avoid a fully closed state or an insufficient opening size due to the contact member 6 being inserted. The vicinity of the boundary between the flapper body 50 and the extension 51 is bent to be recessed on the side opposite to the contact member 6 in the side view. The tip of the contact member 6 may be in contact with the bent part in a stable state.

The actuator 7 allows the contact member 6 to move reciprocally in the direction facing the flapper 5 (horizontal direction), and for example, it is a linear motion type stepping motor, and is assembled to the outer surface of the device body A0 by using a screw member 98 or the like. Further, the actuator 7 may fix the contact member 6 at a desired position within the range of the reciprocating stroke of the contact member 6.

The contact member 6 sets the position where the flapper 5 contacts the contact member 6 as the upper limit position of the rotation of the flapper 5, and prevents the flapper 5 from rotating with a large opening degree beyond this upper limit position. However, it is allowed for the flapper 5 to rotate to an opening degree smaller than that.

The control part 13 executes operation control and various data processing of each part of the hot water device WH, and by controlling the actuator 7 and changing the fixed position of the contact member 6, selectively switches and sets one of the first and second upper limit positions P1 and P2 as the upper limit position of the rotation of the flapper 5.

Figure 4:
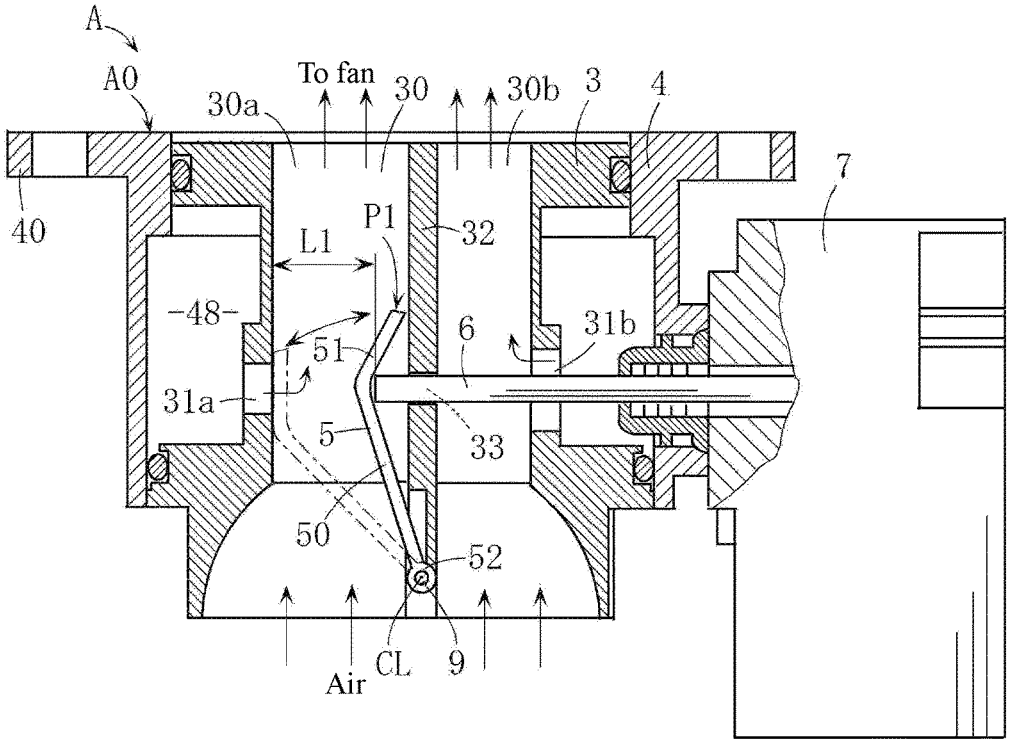
FIG. 4 is a cross-sectional view showing an example of a state in which the position of the contact member of the premixing device shown in FIG. 3 is changed.

Here, the first upper limit position P1 is a position for normal combustion of the combustion device B, and, for example, as shown in FIG. 4, the distance L1 between the tip end of the contact member 6 and the inner wall surface of the gas flow path 30 is relatively large, so the flapper 5 is at a position where it comes into close contact with or comes into contact with the partition wall 32. When setting the first upper limit position P1, the tip end of the contact member 6 may be brought into contact with the flapper 5 to regulate the position of the flapper 5, but instead of this, for example, the flapper 5 may be brought into contact with the partition wall 32 to prevent further rotation, and the tip end of the contact member 6 may be disposed to be separated from the flapper 5.

The second upper limit position P2 is a position for fuel ignition. For example, as shown in (a) of FIG. 3, the distance L2 between the tip end of the contact member 6 and the inner wall surface of the gas flow path 30 is shorter than the distance L1, so the maximum opening degree of the flapper 5 is smaller than that in the case of the first upper limit position P1, and the flapper 5 is located at a position where the flapper 5 approaches the first gas outlet 31*a*.

The upper limit position of the flapper 5 is selectively switched to one of the first and second upper limit positions P1 and P2, and this switching setting is executed by the control of the control part 13 corresponding to the operation mode of the combustion device B. Specifically, in the burner 2 of the combustion device B, when the fuel is ignited, the second upper limit position P2 of the flapper 5 shown in (a)

of FIG. 3 is set. During normal combustion after ignition, the first upper limit position P1 of the flapper 5 shown in FIG. 4 is set.

The actuator 7 may fix the contact member 6 at a desired position within the range of the reciprocating stroke of the contact member 6, and the disposition may be changed. Therefore, both the first and second upper limit positions P1 and P2 of the flapper 5 may be appropriately changed. This change may be made by operating, for example, a remote controller (not shown) provided in the combustion device B (hot water device WH), an operation part provided separately, or the like.

Next, the operations of the premixing device A and the combustion device B described above will be described.

First, when fuel ignition is performed in the burner 2 of the combustion device B, the premixing device A is controlled by the control part 13 and set to a state in which the upper limit position of the flapper 5 is the second upper limit position P2, as shown in (a) of FIG. 3. In this state, since the opening degree of the flapper 5 is suppressed to be small, the flow velocity of the air flowing near the first gas outlet 31*a* is increased, and the negative pressure acting on the first gas outlet 31*a* is strengthened. When the air flow rate in the gas flow path 30 is large, the flapper 5 normally rotates greatly as shown in FIG. 4, but at the time of fuel ignition, such rotation is blocked by the contact member 6, and the state of (a) of FIG. 3 described above is set. Therefore, the amount of fuel gas flowing out from the first gas outlet 31*a* to the gas flow path 30 is increased, and the air-fuel mixture can have a fuel-rich air-fuel ratio and a small ignition energy. This improves the ignition performance.

When the fuel ignition is completed and the burner 2 is in the normal combustion mode, the premixing device A is controlled by the control part 13 and set to a state in which the upper limit position of the flapper 5 is the first upper limit position P1 as shown in FIG. 4. In this state, since the opening degree of the flapper 5 may be made larger than that at the time of fuel ignition, it is possible to avoid the air-fuel ratio of the air-fuel mixture from becoming fuel-rich, and the mixture with an air-fuel ratio suitable for the normal combustion mode of the burner 2 may be obtained. In addition, although the upper limit position of the flapper 5 is restricted to the first upper limit position P1 by the contact member 6, the rotation of the flapper 5 at an angle lower than that is not hindered by the contact member 6. Therefore, the flapper 5 has good responsiveness, and when the air flow rate in the gas flow path 30 becomes smaller than the predetermined flow rate, the flapper 5 rotates rapidly to close the first flow path 30*a* and the first gas outlet 31*a*. As a result, the flow velocity of the air in the second flow path 30*b* becomes high, and an appropriate amount of fuel gas outflow from the second gas outlet 31*b* to the second flow path 30*b* may be appropriately continued.

As described above, according to this embodiment, it is possible to achieve good responsiveness of the operation of the flapper 5, and good performance of maintaining the air-fuel mixture at an appropriate air-fuel ratio during normal combustion of the burner 2. It is also suitable for obtaining a high turndown ratio.

The operation of the flapper 5 to quickly close the first flow path 30*a* and the first gas outlet 31*a* when the air flow rate in the gas flow path 30 becomes smaller than the predetermined flow rate may be similarly generated even in the setting state shown in (a) of FIG. 3, that is, when the upper limit position of the flapper 5 is set to the second upper limit position P2.

In this embodiment, as described above, each of the first and second upper limit positions P1 and P2 of the flapper 5 may be appropriately changed. Therefore, there is an advantage that the first and second upper limit positions P1 and P2 may be adjusted to the optimum positions in consideration of the specific usage conditions of the premixing device A, such as the output of the fan 1 and the type of fuel gas.

The disclosure is not limited to the contents of the above-described embodiments. The specific configuration of each part of the premixing device and the combustion device according to the disclosure may be variously redesigned within the scope of the disclosure.

The flapper 5 in the above-described embodiment switches between an open state and a closed state depending on whether the air flow rate of the first flow path 30*a* is greater than or equal to a predetermined flow rate, but it is not limited thereto. In the disclosure, for example, it may be configured that the opening degree of the flapper 5 changes in a stepless or multi-stepped way according to the air flow rate so that the opening degree of the flapper 5 gradually decreases as the air flow rate of the first flow path 30*a* decreases.

Further, in the above-described embodiment, the gas flow path 30 is divided into the first and second flow paths 30*a* and 30*b*, and the flapper 5 is disposed in the first flow path 30*a*, but the disclosure is not limited thereto. It is also possible to have a configuration in which the flapper 5 is provided without dividing the gas flow path 30 into multiple flow paths.

In the above-described embodiment, the operation regulating part for the flapper is configured by combining a shaft-shaped contact member and an actuator that reciprocally moves the shaft-shaped contact member, but the disclosure is not limited thereto. For example, as the contact member 6, a member other than a shaft-shaped one may be used. Further, as the actuator, a device other than the linear motion type stepping motor may also be used.

The first and second upper limit positions of the flapper in the disclosure may be appropriately selected or changed according to the usage conditions of the premixing device and the like, and the specific positions thereof are not limited.

The gas flow path is preferably, but not limited to, Venturi-like. It is not necessary to provide multiple gas outlets, and at least one gas outlet may be provided. The specific shape, material, size, and the like of the flapper are not limited.

The fuel gas is, for example, natural gas or LP gas, but the specific type of the fuel gas is not limited. The combustion device according to the disclosure is not limited to being applied to the hot water device, and may be a combustion device for other purposes such as for heating and incinerator. Further, the type is not limited to the type in which the combustion gas advances downward, and the type in which the combustion gas advances upward, for example, may be used.

What is claimed is:

1. A premixing device comprising:

a gas flow path for allowing air to flow in a predetermined direction;

at least one gas outlet that allows fuel gas to flow out into the gas flow path by utilizing a negative pressure generated in the gas flow path; and a flapper disposed in the gas flow path, being rotatable around an axis extending in a direction intersecting a flow direction of the air, and changing an opening degree according to an air flow rate so that when the air flow rate in the gas flow path is small, the opening degree is smaller than when the air flow rate is large, the premixing device further comprising:

an operation regulating part for the flapper which allows the opening degree of the flapper to change according to the air flow rate in a range below a predetermined upper limit position while preventing the flapper from rotating in an opening direction beyond the upper limit position, wherein the operation regulating part is capable of selectively switching and setting one of a first upper limit position for normal combustion and a second upper limit position for fuel ignition as the upper limit position of the flapper, and the opening degree of the flapper at the second upper limit position is smaller than the opening degree of the flapper at the first upper limit position.

2. The premixing device according to claim 1, wherein at least the second upper limit position of the first and second upper limit positions is changeable.

3. The premixing device according to claim 2, wherein the operation regulating part comprises a contact member for contacting the flapper and an actuator capable of moving the contact member, a configuration in which the upper limit position of the flapper is set to the second upper limit position is a configuration in which the contact member is contactable with the flapper to prevent the flapper from further rotation when the flapper is at the second upper limit position, and a configuration in which the upper limit position of the flapper is set to the first upper limit position is a configuration in which the contact member or a member other than the contact member is contactable with the flapper to prevent the flapper from further rotation when the flapper is at the first upper limit position.

4. The premixing device according to claim 3, wherein the actuator is capable of reciprocally moving the contact member in a direction facing the flapper, and is capable of fixing the contact member at a desired position within a range of a reciprocating stroke.

5. The premixing device according to claim 4, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

6. The premixing device according to claim 3, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

7. The premixing device according to claim 1, wherein the operation regulating part comprises a contact member for contacting the flapper and an actuator capable of moving the contact member, a configuration in which the upper limit position of the flapper is set to the second upper limit position is a configuration in which the contact member is contactable with the flapper to prevent the flapper from further rotation when the flapper is at the second upper limit position, and a configuration in which the upper limit position of the flapper is set to the first upper limit position is a configuration in which the contact member or a member other than the contact member is contactable with the flapper to prevent the flapper from further rotation when the flapper is at the first upper limit position.

8. The premixing device according to claim 7, wherein the actuator is capable of reciprocally moving the contact member in a direction facing the flapper, and is capable of fixing the contact member at a desired position within a range of a reciprocating stroke.

9. The premixing device according to claim 8, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

10. The premixing device according to claim 7, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

11. A combustion device comprising:

a fan;

a premixing device provided on an intake side of the fan and mixing air and fuel gas and then sending it to the fan; and a burner that burns the fuel gas by receiving a mixture of the air and the fuel gas from the fan, the premixing device according to claim 1 is used as the premixing device.

12. The combustion device according to claim 11, wherein at least the second upper limit position of the first and second upper limit positions is changeable.

13. The combustion device according to claim 12, wherein the operation regulating part comprises a contact member for contacting the flapper and an actuator capable of moving the contact member, a configuration in which the upper limit position of the flapper is set to the second upper limit position is a configuration in which the contact member is contactable with the flapper to prevent the flapper from further rotation when the flapper is at the second upper limit position, and a configuration in which the upper limit position of the flapper is set to the first upper limit position is a configuration in which the contact member or a member other than the contact member is contactable with the flapper to prevent the flapper from further rotation when the flapper is at the first upper limit position.

14. The combustion device according to claim 13, wherein the actuator is capable of reciprocally moving the contact member in a direction facing the flapper, and is capable of fixing the contact member at a desired position within a range of a reciprocating stroke.

15. The combustion device according to claim 14, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

16. The combustion device according to claim 13, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

17. The combustion device according to claim 11, wherein the operation regulating part comprises a contact member for contacting the flapper and an actuator capable of moving the contact member, a configuration in which the upper limit position of the flapper is set to the second upper limit position is a configuration in which the contact member is contactable with the flapper to prevent the flapper from further rotation when the flapper is at the second upper limit position, and a configuration in which the upper limit position of the flapper is set to the first upper limit position is a configuration in which the contact member or a member other than the contact member is contactable with the flapper to prevent the flapper from further rotation when the flapper is at the first upper limit position.

18. The combustion device according to claim 17, wherein the actuator is capable of reciprocally moving the contact member in a direction facing the flapper, and is capable of fixing the contact member at a desired position within a range of a reciprocating stroke.

19. The combustion device according to claim 18, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

20. The combustion device according to claim 17, wherein the gas outlet comprises a first gas outlet and a second gas outlet provided on an inner peripheral wall of the gas flow path to be located in regions on opposite sides to each other across a center of the gas flow path, and the flapper is provided to be able to approach and separate from the first gas outlet, and the contact member is inserted into the second gas outlet without completely closing the second gas outlet, and one end of the contact member is contactable with the flapper, and the other end of the contact member is supported by the actuator provided outside the gas flow path.

* * * * *